US005108885A

United States Patent [19]

Yasunami et al.

[11] Patent Number: 5,108,885

[45] Date of Patent: Apr. 28, 1992

[54] SILVER HALIDE PHOTOGRAPHIC MATERIAL CONTAINING CROSSLINKED POLYMER

[75] Inventors: Shoichiro Yasunami; Yasuo Mukunoki, both of Kanagawa, Japan

[73] Assignee: Fuji Photo Film Co., Ltd., Kanagawa, Japan

[21] Appl. No.: 547,552

[22] Filed: Jul. 3, 1990

[30] Foreign Application Priority Data

Jul. 3, 1989 [JP] Japan ..... 1-171465

[51] Int. Cl.[5] ..... G03C 1/76

[52] U.S. Cl. ..... 430/531; 430/527; 430/528; 430/523

[58] Field of Search ..... 430/527, 528, 532, 531, 430/523

[56] References Cited

U.S. PATENT DOCUMENTS 4,914,013 4/1990 Besio et al. ..... 430/531

*Primary Examiner*—Jack P. Bramer

*Attorney, Agent, or Firm*—Sughrue, Mion, Zinn, Macpeak & Seas

[57] ABSTRACT

A silver halide photographic material comprising a support having thereon at least one silver halide emulsion layer, wherein at least one of the layers of the photographic material is a layer which is crosslinked after coating a coating liquid comprising a polymeric compound which has at least repeating units represented by formula (I) or formula (II):

(I)

(II)

wherein, $L_1$, $L_2$, $L_3$, $L_4$, $L_5$, $L_6$, $L_7$, $L_8$ and $L_9$, which may be the same or different, each represents a divalent linking group; $X_1$ and $X_2$, which may be the same or different, each represents a crosslinkable groups which contain an activated vinyl component; $Y_1$, $Y_2$, $Y_3$ and $Y_4$, which may be the same or different, each represents a hydrogen atom, an alkyl group, an alkenyl group, an aryl group, an aralkyl group or a crosslinkable group which contains an activated vinyl component; $Z_1$ and $Z_2$, which may be the same or different, each is a counter ion for balancing the electrical charge; and r is 0 or 1, provided that when r is 0, $L_4$ and $L_6$ together form a condensed ring.

9 Claims, No Drawings

SILVER HALIDE PHOTOGRAPHIC MATERIAL CONTAINING CROSSLINKED POLYMER

FIELD OF THE INVENTION

This invention concerns silver halide photographic materials which have good antistatic properties; and in particular it concerns silver halide photographic materials (referred to hereinafter as "photographic materials") where no adverse effect on the coating properties arises, where no contamination of the development processing baths when the materials are processed in an automatic processor arises, and where properties which result in attachment of dust after processing are improved.

BACKGROUND OF THE INVENTION

Photographic materials generally comprise a support which has electrically insulating properties and a photographic layer. In many cases electrostatic charges build up as a result of contact friction with, or separation from, the surface of a material of the same or a different type during the manufacture or use of the photographic material. The accumulated electrostatic charge causes a lot of damage, but most importantly spots or dendritic or feather-like lines appear when the photographic film is developed when of the light-sensitive emulsion layer is exposed as a result of the discharge of the accumulated electrostatic charge prior to development processing. These types of marks are usually referred to as static marks, and the commercial value of the photographic film can be reduced to a considerable degree and, depending on the particular case, it may be lost completely.

The accumulated electrostatic charge may also cause dust to be become attached to the surface of the film, and it may give rise to other secondary problems such as preventing a uniform coating.

Such electrostatic charges are generated as a result of contact with and separation from mechanical parts during the manufacture of the photographic material, as mentioned earlier, or in various types of automatic camera devices. Static mark formation has increased recently because of the increased photographic speeds of photographic materials and as a result of the more vigorous handling of the material during high speed coating, high speed camera operation and high speed automatic development processing. Moreover, the attachment of dust has become a problem when processed films are handled.

The addition of an antistatic agent to a photographic material is desirable to prevent the occurrence of such problems due to static electricity. However, antistatic agents which are used generally in other fields cannot be used without changing the photographic materials. Various limitations exist when antistatic agents are used photographic materials. In addition to excellent antistatic performance, the antistatic agents used in photographic materials must not adversely affect the photographic characteristics, such as photographic speed, fog level, graininess and sharpness, of the material, must not adversely affect the film strength of the material and must not adversely affect antistick properties. Also they must not increase the rate at which the development bath for the photographic material becomes fatigued, they must not contaminateautomatic developing machine transporting rollers and they must not reduce the strength of adhesion between the various structural layers of the photographic material. A large number of limitations are thus imposed on the use of antistatic agents in photographic materials.

One way of minimizing the problems due to static electricity is to increase the electrical conductivity of the surface of the photographic material so that the electrostatic charge is dispersed quickly before an accumulated charge can discharge. This is especially effective in terms of the attachment of dust after processing.

Hence, methods of increasing the electrical conductivity of the support and the various coated surface layers of a photographic material have been considered in the past. Attempts have been made to use various hygroscopic substances and water soluble substances, and certain types of surfactants and polymers, for example.

However, these substances may be specific to the type of film support and differences in photographic composition, and the electrical conductivity may be lost after processing and dust may become attached to the film. Moreover, there may be a humidity dependence and static charges may build up under low humidity conditions, there may be an adverse effect on photographic performance, coating properties or transparency, there may be a deterioration in adhesion, or contamination of the development processing baths may occur. Thus, it is very difficult to use these materials in photographic materials.

SUMMARY OF THE INVENTION

A first object of the present invention is to provide photographic materials which have good antistatic properties even when contact is made in different ways.

A second object of the present invention is to provide photographic materials which have excellent antistatic properties and which have improved prevention of attachment of dust.

A third object of the present invention is to provide photographic materials which are rendered antistatic without development processing bath contamination occurring.

A fourth object of the present invention is to provide photographic materials which have rendered antistatic properties without any adverse effect on transparency.

A fifth object of the present invention is to provide photographic materials which are rendered antistatic without adverse effects on the adhesion properties before or after development processing.

These objects of the present invention are achieved with a silver halide photographic material comprising a support having thereon at least one silver halide emulsion layer, wherein at least one of the structural layers of the photographic material is a layer which is crosslinked after coating a coating liquid comprising a polymeric compound which has at least repeating units represented by formula (I) or formula (II):

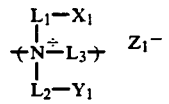

(I)

-continued

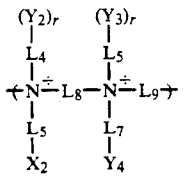

(II)

Wherein, $L_1L_2$, $L_3$, $L_4$, $L_5$, $L_6$, $L_7$, $L_8$ and $L_9$, each individually represents a divalent linking group $X_1$ and $X_2$ each represents a crosslinkable group which contains an activated vinyl component; $Y_1$, $Y_2$, $Y_3$ and $Y_4$ each represents a hydrogen atom, an alkyl group, an alkenyl group, an aryl group, an aralkyl group or a crosslinkable group which contains an activated vinyl component; $Z_1$ and $Z_2$ each is a counter ion for balancing the electrical charge; and r is 0 or 1, provided that when r is 0, $L_4$ and $L_6$ together form a condensed ring.

DETAILED DESCRIPTION OF THE INVENTION

The polymeric compounds used in the present invention have quaternary ammonium groups in the main chain and as a result have excellent antistatic performance. They also have crosslinkable groups in the side chains and, by crosslinking these groups, surprisingly excellent adhesion properties with no loss of antistatic performance after development processing is achieved and no contamination of the development processing baths. Thus, the objects of the present invention can be realized with these compounds.

Formulae (I) and (II) compounds are described in detail below.

$L_1$ and $L_2$ in formula (I) may be the same or different, and each represents a divalent linking group. In practice they can be represented by formula (III) indicated below.

$$-A-(B)_a-(C)_b- \quad \text{(III)}$$

A and C, which may be the same or different, each represents an alkylene group having 1 to 10 carbon atoms, an arylene group having 6 to 12 carbon atoms, or a group comprising a combination of such groups, having 7 to 16 carbon atoms, and B represents —CO—, —$CO_2$—, —0—CO—,

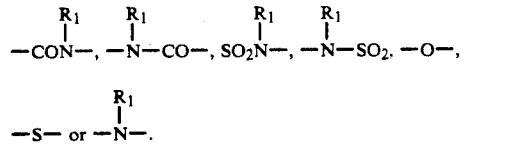

$R_1$ is a hydrogen atom or an alkyl group having 1 to 4 carbon atoms. Moreover, a and b may be the same or different, and each is 0 or 1.

Preferred examples of $L_1$ and $L_2$ are indicated below:

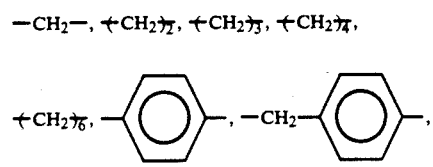

-continued

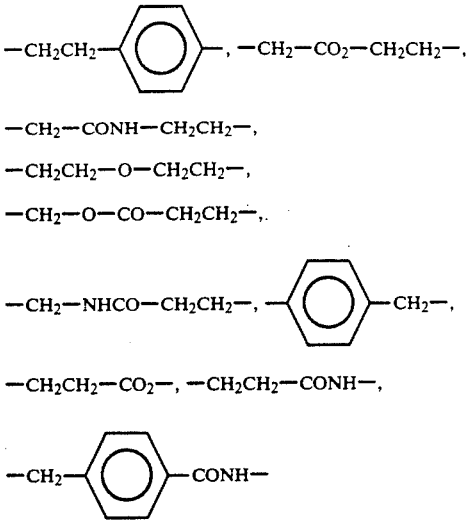

These groups may be substituted with substituent groups. Examples of suitable substituent groups for the alkylene groups include halogen atoms (e.g., fluorine, chlorine, bromine), cyano groups, sulfo groups, hydroxyl groups, carboxyl groups, alkyl groups, aryl groups, aralkyl groups, acyloxy groups, acylamino groups, amino groups, sulfonamido groups, alkoxy groups, aryloxy groups, alkylthio groups, arylthio groups, carbamoyl groups, sulfamoyl groups, alkoxycarbonyl groups, aryloxycarbonyl groups, alkylsulfonyl groups, arylsulfonyl groups, alkoxysulfonyl groups, aryloxysulfonyl groups, carbamoylamino groups, sulfamoylamino groups, carbamoyloxy groups, alkoxycarbonylamino groups and aryloxycarbonylamino groups.

Examples of suitable substituent groups for the arylene groups include alkyl groups having 1 to 20 carbon atoms, substituted alkyl groups, halogen atoms (e.g., fluorine, chlorine, bromine), hydroxyl groups, carboxyl groups, sulfo groups, acylamino groups, sulfonamido groups, carbamoyl groups, acyloxy groups, alkoxycarbonyl groups, acyl groups, alkoxy groups, aryloxy groups, nitro groups, formyl groups, and alkyl and aryl sulfonyl groups. A plurality of these substituent groups may be present.

$L_3$ represents a divalent group, and actual examples include alkylene groups, arylene groups and combinations of these groups. $L_3$ is preferably an alkylene group having 1 to 16 carbon atoms or a group in which an arylene group is combined with an alkylene group having 1 to 20 carbon atoms. $L_3$ most desirably is an alkylene group having 1 to 10 carbon atoms or a group in which an arylene group is combined with an alkylene group having 1 to 12 carbon atoms.

$L_3$ may be substituted with substituent groups. The groups described as substituent groups for the alkylene groups represented by $L_1$ may be present as substituent groups when $L_3$ is an alkylene group. The groups described as substituent groups for the arylene groups represented by $L_1$ may be present as substituent groups when $L_3$ is an arylene group.

Preferred examples of $L_3$ include an ethylene group, a propylene group, a hexylene group and a p-xylylene group.

$X_1$ is a crosslinkable group which contains an activated vinyl component, and actual examples can be represented by formulae (IV) and (V) indicated below.

$$-V_1-\underset{\underset{O}{\|}}{C}\left(CH=CH\right)_p T_1 \qquad \text{(IV)}$$

$$\left(T_2\right)_q\left(CH=CH\right)_p-\underset{\underset{O}{\|}}{C}-V_2-R_2 \qquad \text{(V)}$$

In formulae (IV) and (V), $V_1$ and $V_2$ each represents —0— or $$-\overset{\overset{R_3}{|}}{N}-,$$

and $R_3$ has the same meaning as $R_1$. $V_1$ and $V_2$ are preferably —0— or $$-\overset{\overset{R_3}{|}}{N}-$$

(wherein $R_3$ represents a hydrogen atom or an alkyl group having 1 to 3 carbon atoms). $T_1$ represents an aryl group,

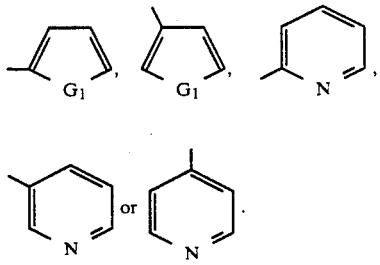

$G_1$ represents —0—, —S— or $$-\overset{\overset{R_4}{|}}{N}-,$$

and $R_4$ has the same meaning as $R_1$.

$T_1$ is preferably one of the groups indicated below, and these groups may be substituted.

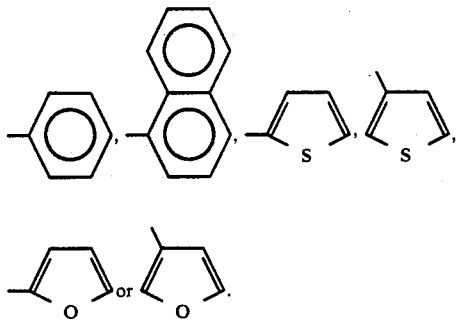

$T_2$ represents an arylene group,

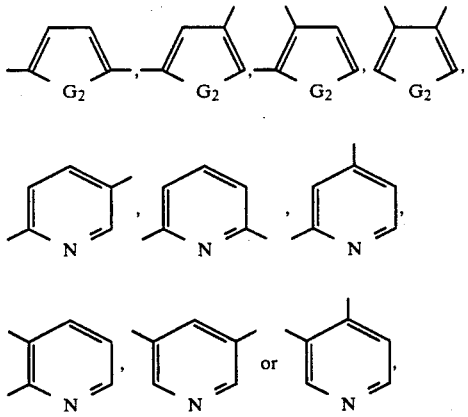

and $G_2$ has the same meaning as $G_1$. The groups represented by $T_1$ and $T_2$ may be substituted. The groups described as substituent groups for the arylene groups represented by $L_1$ are examples of suitable substituent groups. $T_2$ is preferably a group such as those indicated below, and these may be substituted.

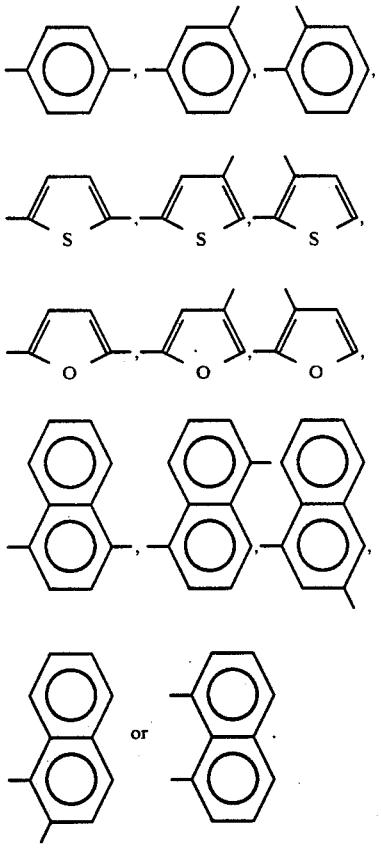

$R_2$ represents a hydrogen atom, an alkyl group, an alkenyl group, an aryl group or an aralkyl group, and the alkyl groups, alkenyl groups, aryl groups and aralkyl groups may have substituent groups. Examples of substituent groups for the alkyl and alkenyl groups are the same as those described as substituent groups for the alkenyl groups represented by $L_1$, and examples of substituent groups for the aryl groups and aralkyl groups are the same as those described as substituent groups for the arylene groups represented by $L_1$.

$R_2$ is preferably a hydrogen atom, an alkyl group having 1 to 10 carbon atoms or an aryl group having 6 to 15 carbon atoms or an aralkyl group. $R_2$ is most desirably a hydrogen atom, an alkyl group having 1 to 6 carbon atoms (e.g., methyl, ethyl, propyl), a phenyl group or an aralkyl group having 7 to 10 carbon atoms (e.g., 4-methylphenyl, 4-tert-butylphenyl).

Moreover, p and p' each is 1 or 2, and q is 0 or 1.

Preferred examples of X are indicated below:

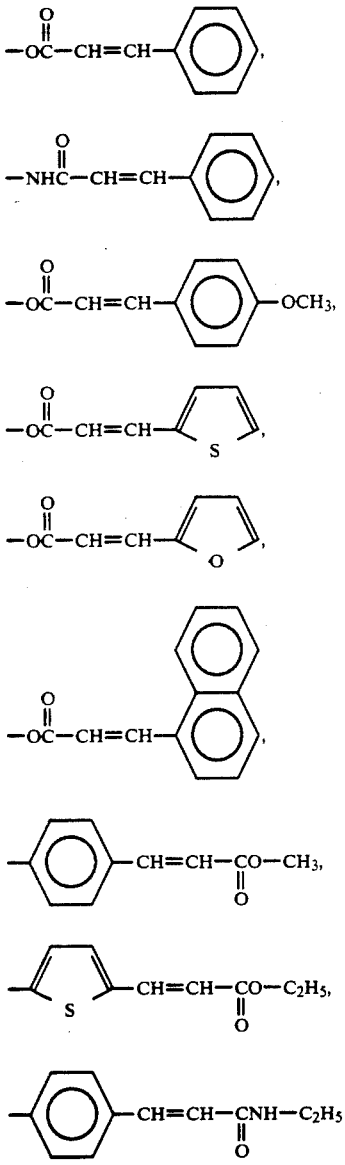

Futhermore, in formula (I), $Y_1$ represents a hydrogen atom, an alkyl group, an alkenyl group, an aryl group, an aralkyl group or a crosslinkable group which contains an activated vinyl component. Where $Y_1$ is a crosslinkable group which contains an activated vinyl component, $Y_1$ has the same meaning as $X_1$. These groups, with the exception of a hydrogen atom, may be substituted, and examples of substituent groups for the alkyl and alkenyl groups include those described as substituent groups for the alkylene groups represented by $L_1$. Examples of substituent groups for the aryl and aralkyl groups include those described as substituent groups for the arylene groups represented by $L_1$.

$Y_1$ is preferably a hydrogen atom, an alkyl group which may be substituted and which has from 1 to 10 carbon atoms, an aryl group which may be substituted and which has from 6 to 15 carbon atoms, or a crosslinkable group which contains an activated vinyl component. $Y_1$ is most desirably a hydrogen atom, an alkyl group which may be substituted and which has from 1 to 6 carbon atoms, an aryl group which may be substituted and which has from 6 to 12 carbon atoms, or a crosslinkable group which contains an activated vinyl component.

$Z_1$ and $Z_2$ each represents a counter ion for balancing the electrical charge. $Z_1$ and $Z_2$ are preferably halogen ions (e.g.,, bromine ion, chlorine ion, iodine ion), $ClO_4^-$, $BF_4^-$, $PF_6^-$, $R_4'—SO_3^-$, wherein $R_4'$ represents a hydrogen atom, an alkyl group having 1 to 10 carbon atoms, an aryl group having 6 to 10 carbon atoms or an aralkyl group. Furthermore, where $R_4'$ is an alkyl group, an aryl group or an aralkyl group, $R_4$ may be substituted. The substituent groups for the alkyl groups are the same as those described as substituent groups for the alkylene groups represented by $L_1$ and the substituent groups for the aryl and aralkyl groups are those described as substituent groups for the arylene groups represented by $L_1$.

In formula (II), $L_8$ and $L_9$, which may be the same or different, each has the same meaning as $L_3$. $L_4$, $L_5$, $L_6$ and $L_7$, which may be the same or different, each has the same meaning as $L_1$. $X_2$ has the same meaning as $X_1$, and $Y_2$, $Y_3$ and $Y_4$, which may be the same or different, each has the same meaning as $Y_1$. Moreover, r is 0 or 1, and when r is 0 then $L_5$ and $L_6$ are joined to form a condensed ring.

$Z_2$ has the same meaning as $Z_1$. The polymer compounds used in the present invention preferably have repeating units represented by formula (VI) or formula (VII) indicated below in addition to the repeating units represented by formula (I) or formula (II) in order to improve antistatic performance.

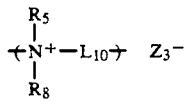

(VI)

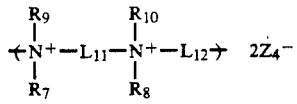

(VII)

$R_5$ and $R_6$ in formula (VI), which may be the same or different, each represents an alkyl group, an aryl group or a group in which such groups are combined, and these groups may be substituted. Examples of substituent groups for the alkyl group include those described as substituent groups for the alkylene group represented by $L_1$. Examples of substituent groups for the aryl group include those described as substituent groups for the arylene group represented by $L_1$.

$R_5$ and $R_6$ are preferably alkyl groups which may be substituted and which have from 1 to 12 carbon atoms, aryl groups which may be substituted and which have from 6 to 12 carbon atoms, or groups in which such groups are combined, and most desirably they are alkyl groups which may be substituted and which have from 1 to 8 carbon atoms, aryl groups which may be substituted and which have from 6 to 9 carbon atoms, or combinations of such groups.

$L_{10}$ represents a divalent linking group, and $Z_3$ is a counter ion for balancing the electrical charge.

In formula (VII) $L_{11}$ and $L_{12}$ which may be the same or different, each represents a divalent linking group. $R_7$, $R_8$, $R_9$ and $R_{10}$ represents an alkyl group, an aryl group or a group in which such groups are combined. $R_7$ and $R_8$, $R_9$ and $R_{10}$, $R_7$ and $R_9$, and $R_8$ and $R_{10}$ may be joined to form a condensed ring.

$Z_4$ represents a counter ion for balancing the electrical charge.

Examples of repeating units represented by formula (I) or (II) are indicated below, but the repeating units are not limited to these examples.

(C-1)

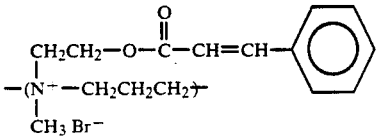

(C-2)

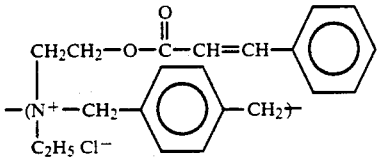

(C-3)

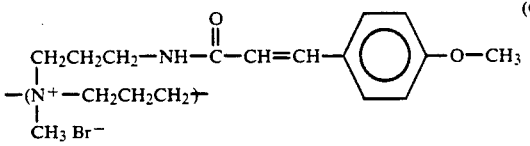

(C-4)

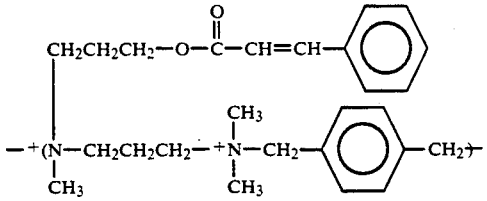

(C-5)

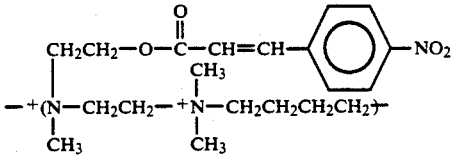

(C-6)

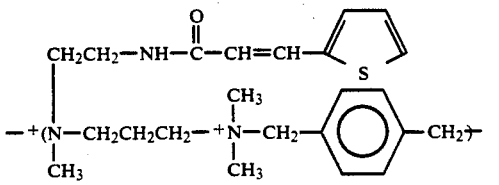

-continued (C-7)

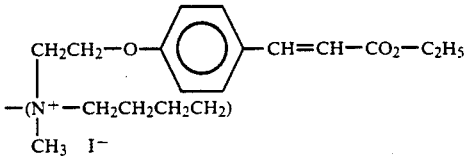

(C-8)

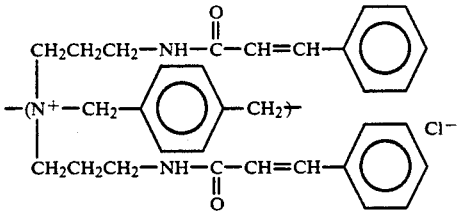

(C-9)

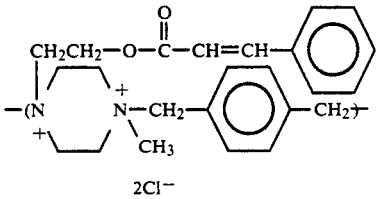

(C-10)

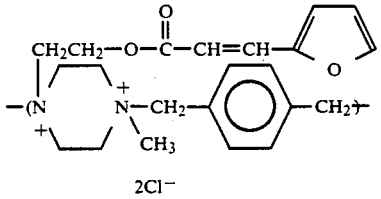

(C-11)

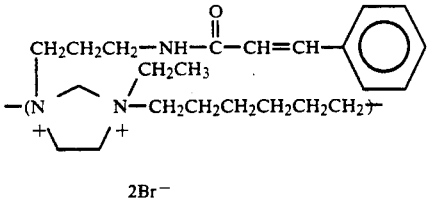

(C-12)

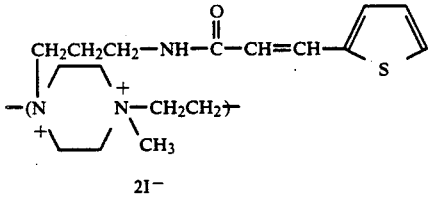

(C-13)

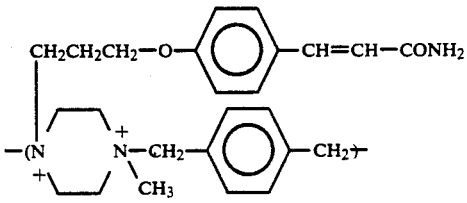

-continued
(C-14)
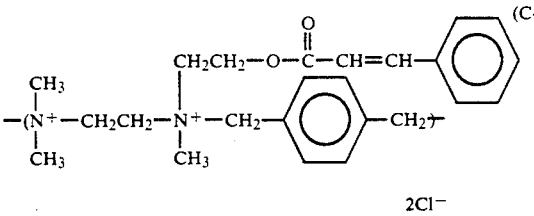
(C-15)
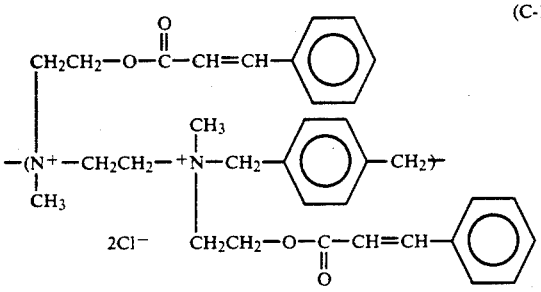
-continued
(C-16)
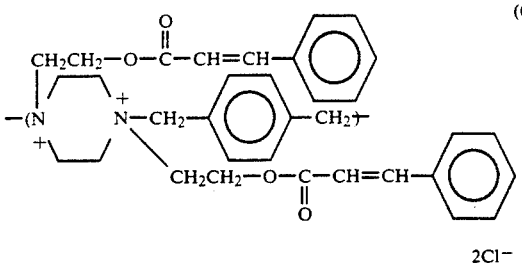
(C-17)
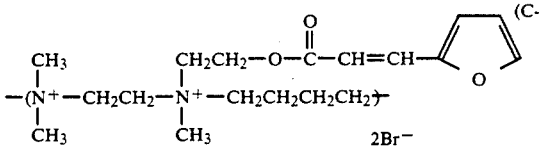
Examples of repeating units represented by formula (VI) or (VII) are indicated below, but the repeating units are not limited to these examples.
(D-1)
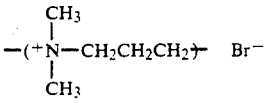
(D-2)
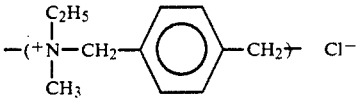
(D-3)
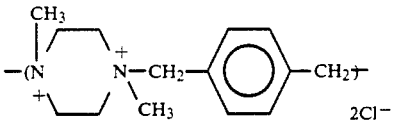
(D-4)
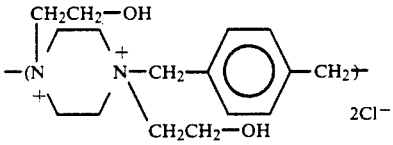
(D-5)
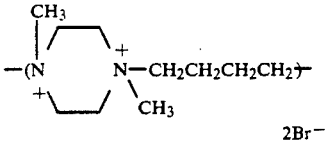
(D-6)
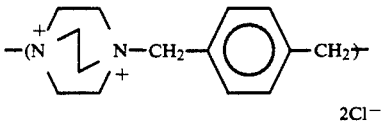
(D-7)
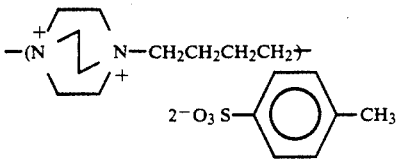

-continued (D-8)

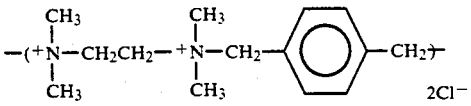

(D-9)

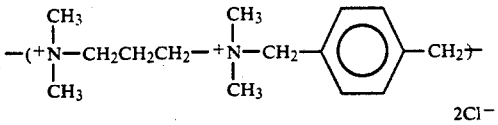

(D-10)

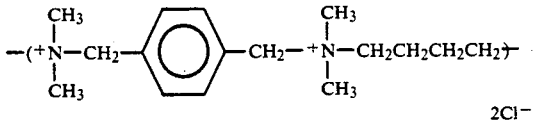

(D-11)

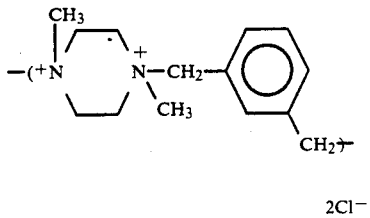

(D-12)

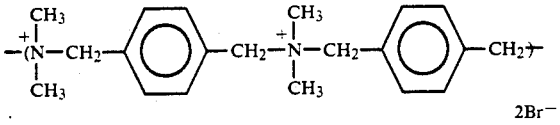

(D-13)

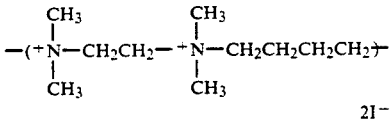

The polymer compounds which can be used in the present invention may have a plurality of repeating units represented by formula (I) or (II) and a plurality of repeating unit represented by formula (VI) or (VII).

The polymer compounds used in the present invention preferably contain from 2 to 60 mol%, and most desirably from 5 to 40 mol%, of units represented by formula (I) or (II).

The weight average molecular weight $\overline{Mw}$ (calculated in terms of polyethylene oxide) of the polymer compounds used in the present invention is preferably from 500 to 2,000,000, and most desirably from 2,000 to 1,000,000.

Examples of polymer compounds which can be used in the present invention are indicated below, but the compounds are not limited to these examples.

TABLE 1A

| Illustrative Compound | Repeating Unit of Formula (I) or (II) (X) | Repeating Unit of Formula (III) or (IV) (Y) | Repeating Unit Ratio X/Y (mol ratio) |
|---|---|---|---|
| P-1 | C-9 | D-3 | 20/80 |
| P-2 | C-9 | D-6 | 30/70 |
| P-3 | C-8 | D-3 | 15/85 |
| P-4 | C-8 | D-5 | 25/75 |
| P-5 | C-4 | D-9 | 15/85 |
| P-6 | C-4 | D-9 | 30/70 |
| P-7 | C-10 | — | 100/0 |
| P-8 | C-9 | — | 100/0 |
| P-9 | C-2 | D-8 | 40/60 |
| P-10 | C-4 | D-3 | 20/80 |
| P-11 | C-4 | D-3 | 40/60 |
| P-12 | C-4 | D-6 | 15/85 |

TABLE 1A-continued

| Illustrative Compound | Repeating Unit of Formula (I) or (II) (X) | Repeating Unit of Formula (III) or (IV) (Y) | Repeating Unit Ratio X/Y (mol ratio) |
|---|---|---|---|
| P-13 | C-5 | D-13 | 20/80 |
| P-14 | C-5 | D-13 | 35/65 |
| P-15 | C-17 | D-13 | 25/75 |
| P-16 | C-17 | D-8 | 10/90 |
| P-17 | C-12 | D-5 | 20/80 |
| P-18 | C-12 | D-6 | 20/80 |
| P-19 | C-13 | D-3 | 20/80 |
| P-20 | C-13 | D-4 | 35/65 |
| P-21 | C-10 | D-6 | 20/80 |
| P-22 | C-8 | D-6 | 30/70 |
| P-23 | C-13 | D-6 | 15/85 |
| P-24 | C-16 | D-6 | 10/90 |
| P-25 | C-9 | D-10 | 20/80 |

An example of the synthesis of a polymer compound which can be used in the present invention is described below. Unless otherwise indicated, all parts, percents, ratios and the like ar by weight.

EXAMPLE OF SYNTHESIS 1

Preparation of Compound P-2

(1) Preparation of N-(2-Hydroxyethyl)-N'-methylpiperazine

N-Methylpiperazine (50 grams, 0.5 mol) was dissolved with heating in 50 ml of acetonitrile, 0.5 gram of KOH was added and ethylene oxide gas was introduced while stirring the mixture at a temperature of from 80°

C. to 100°. The change in weight of the system was observed and the flow of ethylene oxide was stopped when an equimolar amount had been introduced. After completion of the reaction, the acetonitrile was removed by distillation and the residue was distilled under reduced pressure to provide a colorless transparent oil (boiling point 120°-127° C. at 30 mm·Hg).

Recovery 37 grams (yield 51%)

The chemical structure was confirmed using IR, NMR, elemental analysis and GC.

(2) Preparation of
N-(2-Cinnamoyloxy)-N'-methylpiperazine

N-(2-Hydroxyethyl)-N'-methylpiperazine (30 grams, 0.21 mol) and 22 grams of triethylamine (0.22 mol) were dissolved in 200 ml of acetonitrile and an acetonitrile solution containing 36.7 cc (0.22 mol) of cinnamoyl chloride was added dropwise over a period of 30 minutes at a temperature of from 0° C. to 5° C. The mixture was reacted for a period of 4 hours at room temperature after the addition had been completed.

After reaction, 500 ml of ethyl acetate was added and the mixture was washed once with 500 ml of water, once with 300 ml of water, once with 300 ml of 5% aqueous bicarbonate and once with 300 ml of water, after which the organic layer was dried over anhydrous sodium sulfate, the solvent was removed by distillation, the residue was subjected to treatment on a silica gel column (chloroform/methanol) and the target compound was obtained.

Recovery: 45 gram (yield 78%)

The chemical structure was confirmed using IR, NMR and elemental analysis.

(3) Preparation of Compound P-2

N-(2-Cinnamoyloxy)-N'-methylpiperazine (10 grams, 0.036 mol), 9.4 grams (0.084 mol) of 1,4-diazabicyclo-2,2,2-octane and 21 grams (0.12 mol) of p-xylylenedichloride were dissolved in 200 ml of ethanol and reacted with stirring for 48 hours at a temperature of from 50° C. to 60° C.

After reaction, 100 ml of ethanol was distilled away and the mixture was reprecipitated with the addition of 500 ml of hexane. The solid so obtained was dissolved in 100 ml of ethanol and reprecipitated by the addition of 500 ml of benzene, and the target compound was obtained.

Recovery: 34.3 grams (85%) $M\overline{w} \approx 22{,}000$

The chemical structure was confirmed using NMR and elemental analysis.

The polymer compound used in the present invention is added to at least one silver halide emulsion layer or other structural layer or layers of the photographic material. The other structural layer may be, for example, a surface protecting layer, a backing layer, an intermediate layer or a subbing layer. The addition is preferably made to a subbing layer.

In those cases where the subbing layer comprises two layers, the compound may be added to either layer.

The application of the polymer compounds of the present invention to photographic materials may involve coating the compounds as they are, or coating the compounds after the preparation of a coating liquid by dissolution or dispersion of the compound in a suitable solvent. Water or an organic solvent, such as methanol, ethanol, isopropanol, acetone, hexane, ethyl acetate, dimethylsulfoxide, dioxane, chloroform, methylene chloride, toluene, benzene, ether, cyclohexane or methyl ethyl ketone, or a mixture of these solvents, can be used as suitable solvents.

Coating can be achieved using dip coating air knife coating, disc coating, gravure coating, extrusion coating, curtain coating, spraying, extrusion coating using a hopper disclosed in U.S. Pat. No. 2,681,294, and two or more types of layers may be coated simultaneously using the methods disclosed, for example, in U.S. Pat. Nos. 3,508,947, 2,941,898 and 3,526,528, or using methods in which the material is immersed in a coating liquid.

In the present invention, the polymer compound of the invention is crosslinked for use by irradiation or by heating after forming a film. Crosslinking by irradiation is preferred. The use of ultraviolet or visible light, an electron beam or X-rays is preferred as the radiation in this case. The addition of a radiation sensitizer is desirable to speed up the crosslinking reaction with crosslinking by irradiation. In this case, when a coated film is formed with a coating liquid without a solvent, the film can be crosslinked to form a film directly. When a solvent is used, the solvent can be removed (by evaporation or by washing with water) after crosslinking the coatong to form a layer which comprises a polymer compound of the present invention. Alternatively the crosslinking ca be carried out after first removal of the solvent. The irradiation conditions can be selected arbitrarily depending on the type of radiation used and its intensity.

Sensitizers which can be used in the above-described radiation crosslinking include, for example, benzophenone derivatives, benzanthrone derivatives, quinone derivatives, aromatic nitro compounds, naphthothiazoline derivatives, benzothiazoline derivatives, thioxanthones, naphthothiazole derivatives, ketocoumarin compounds, benzothiazole derivatives, naphthofuranone compounds, pyrylium salts and thiapyrylium salts. Specific examples of these compounds include Michler's ketone, N,N'-diethylaminobenzophenone, 1,2-benzanthraquinone, benzanthrone, (3-methyl-1,3-diaza-1,9-benzo)anthrone, picramide, 5-nitroacenaphthene, 2,6-dichloro-4-nitroaniline, p-nitroaniline, 2-chlorothioxanthone, 2-isopropylthioxanthone, dimethylthioxanthone, methylthioxanthone-1-ethylcarboxylate, 2-nitrofluorene, 2-dibenzoylmethylene-3-methylnaphthothiazoline, 3,3-carbonyl-bis(7-diethylaminocoumarin), 2,4,6-triphenylthiapyrylium perchlorate, 2-(p-chlorobenzoyl)naphthothiazole, erythrosin, Rose Bengale and eosine G. The amount of these sensitizers added is from about 1 to about 20 wt%, and preferably from 3 to 10 wt%, with respect to the polymer compound which is used in the invention.

Furthermore, where crosslinking is achieved by heating, the reaction time can be shortened by using known initiators such as peroxides, azobis compounds or hydroperoxides. In this case, the amount of the initiator added is preferably from 0.01 to 5 mol%, and most desirably from 0.1 to 3 mol%, with respect to the polymer compound which is used in the invention. Moreover, the temperature to which the material is heated is preferably from 40° to 150° C., and most desirably from 50° to 120° C.

Furthermore, blends with other polymer compounds can be used in the layer which contains the polymer compound of the present invention. Synthetic resins, such as phenolic resins, urea resins, melamine resins, silicone resins, vinylidene chloride resins, polystyrene resins, polyethylene resins, vinyl chloride resins and polyamide resins, synthetic rubbers, such as styrene butadiene rubber, butadiene rubber, isoprene rubber, butyl rubber, nitrile rubber, chloroprene rubber and ethylene propylene rubber, and poly(vinyl acetate) based polymers, polystyrene based polymers, polyethylene based polymers and poly(ethyl (meth)acrylate) based polymers, for example, can be used as blend polymer compounds in the present invention. No particular limitation is imposed upon these polymers.

The polymer compounds of the present invention are used in an amount of from 0.0001 to 2.0 grams, preferably from 0.0005 to 1.0 gram, and most desirably of from 0.001 to 0.5 gram, per square meter of photographic material.

Two or more types of polymer compounds of the present invention can be used in the form of a mixture, if desired.

The photographic materials of the present invention may be, for example, conventional black-and-white silver halide photographic materials (e.g., camera black-and-white sensitive materials, X-ray black-and-white materials or black-and-white materials for printing purposes), conventional multi-layer color photographic materials (e.g., color negative films, color reversal films, color positive films or color negative films for cinematographic purposes), or infrared type sensitive materials for use with laser scanners.

No particular limitation is imposed on the type of silver halide which is used in the silver halide emulsion layers and surface protecting layers of the photographic materials of the present invention, on the method of manufacture or the method of chemical sensitization, or on the antifoggants, stabilizers, film hardening agents, antistatic agents, couplers, plasticizers, lubricants, coating promotors, matting agents, whiteners, spectral sensitizers, dyes and ultraviolet absorbers, for example, which are used. In this connection reference can be made, for example, to *Product Licensing*, volume 92, pages 107–110 (December 1971), Research Disclosure, volume 176, pages 22–31 (December 1978) and ibid, volume 238, pages 44–46 (1984).

Surfactants can be present in the photographic emulsion layers or other hydrophilic colloid layers of photographic materials in accordance with the present invention for various purposes, for example, as coating promotors or as antistatic agents, to improve slip properties, for emulsification and dispersion purposes, to prevent sticking and to improve photographic performance (e.g., accelerating development, increasing contrast or increasing photographic speed).

For example, nonionic surfactants, such as saponin (steroid based), alkylene oxide derivatives (e.g., polyethylene glycol, polyethylene glycol/polypropylene glycol condensate, polyethylene glycol alkyl ethers or polyethylene glycol alkyl aryl ethers, polyethylene glycol esters, polyethylene glycol sorbitan esters, polyalkylene glycol alkyl amines or amides, and poly(ethylene oxide) adducts of silicones), glycidol derivatives (e.g., alkenylsuccinic acid polyglyceride, alkylphenol polyglyceride), fatty acid esters of polyhydric alcohols and sugar alkyl esters; anionic surfactants which include acidic groups, such as carboxylic acid groups, sulfo groups, phospho groups, sulfate ester groups and phosphate ester groups, for example, alkylcarboxylates, alkylsulfonates alkylbenzenesulfonates, alkylnaphthalenesulfonates, alkyl sulfate esters, alkyl phosphate esters, N-acyl-N-alkyltaurines, sulfosuccinate esters, sulfoalkylpolyoxyethylene alkylphenyl ethers and polyoxyethylene alkylphosphate esters; amphoteric surfactants, such as amino acids, aminoalkylsulfonic acids, aminoalkyl sulfate or phosphate esters, alkylbetaines and amine oxides, and cationic surfactants, such as alkylamine salts, aliphatic or aromatic quaternary ammonium salts, heterocyclic quaternary ammonium salts, for example pyridinium salts and imidazolium salts, and phosphonium salts and sulfonium salts which contain aliphatic or heterocyclic rings can be used.

These materials are described, for example, in R. Oda, *Surfactants and their Applications*, (Shinshoten, 1964), H. Horiguchi, *New Surfactants*, Sankyo Shuppan (Co.), 1975) or *McCutcheon's Detergents and Emulsifiers* (McCutcheon Division, MC Publishing Co., 1985), and in JP-A-60-76741, JP-A-62-172343, JP-A-62-173459 and JP-A-62-215272 (the term "JP-A" as used herein means an "unexamined published Japanese patent application").

Other antistatic agents can be used in combination in the present invention. For example, the fluorine containing surfactants and polymers disclosed in JP-A-62-215272, the nonionic surfactants disclosed, for example, in JP-A-60-76742, JP-A-60-80846, JP-A-60- 80848, JP-A-60-80839, JP-A-60-76741 and JP-A-58-208743, and the electrically conductive polymers or latexes (nonionic, anionic, cationic, amphoteric) disclosed in JP-A-57- 20450 and JP-A-62-215272 can be used in this way. Furthermore, ammonium, alkali metal and alkaline earth metal halides, sulfates, perchlorates, acetates, phosphates and thiocyanates, for example, and electrically conductive tin oxide, zinc oxide and composite oxides in which these metal oxides have been doped with antimony, for example, as disclosed, for example, in JP-A-57-118242, can be used as inorganic antistatic agents.

Gelatin is useful as a binding agent or protective colloid which can be used in the emulsion layers and intermediate layers of a photographic material of the present invention, but other hydrophilic colloids can be used.

For example, gelatin derivatives, graft polymers of other polymers with gelatin, and proteins such as albumin and casein for example; cellulose derivatives such as hydroxyethylcellulose, carboxymethylcellulose and cellulose sulfate esters, sodium alginate and sugar derivatives such as starch derivatives, and many synthetic hydrophilic polymer materials such as poly(vinyl alcohol), partially acetalated poly(vinyl alcohol), poly(N-vinylpyrrolidone), poly(arcylic acid), poly(methacrylic acid), polyacrylamide, polyvinylimidazole and polyvinylpyrazole, either s homopolymers or as copolymers, can be used.

Acid treated gelatin and enzyme treated gelatin can be used as well as lime treated gelatin, and gelatin hydrolyzates and enzyme degradation products of gelatin can also be used.

The combined use with gelatin of dextran and polyacrylamide of these materials is desirable.

Polyols, such as trimethylolpropane, pentanediol, butanediol, ethylene glycol, glycerine and sorbitol, can be used as plasticizers in the hydrophilic colloid layers of a photographic material of the present invention.

The silver halide grains in the photographic emulsions used in photographic materials of the present invention may have a regular crystalline form, such as a cubic or octahedral form, or they may have a crystalline form such as a spherical or tabular form, or they may have a composite form comprised of these crystalline forms. Moreover, tabular grains as disclosed in *Research Disclosure* volume 225, No. 22534, pages 20–58, JP-A-58-127921 and JP-A- 58-113926 can be used. Mixtures of grains which have various crystalline forms can also be used.

Metal ions can be added during the formation and/or growth of the silver halide grains, using at least one of cadimium salts, zinc salts, lead salts, thallium salts, iridium salts (including complex salts), rhodium salts (including complex salts) and iron salts (including complex salts), and these metal elements may be present within the grains and/or at the grain surface. Using a suitable reducing environment, reduction sensitized nuclei can be provided within the grains or on the surface of the grains.

The unwanted soluble salts may be removed from the silver halide emulsion after the growth of the silver halide grains has been completed, or they may be left in the silver halide emulsion. Where these salts are removed, their removal can be accomplished using methods described in *Research Disclosure* No. 17643 section II.

The silver halide grains may have a uniform silver halide composition throughout or they may be core/-shell grains in which the silver halide compositions of the interior and surface layer are different.

The silver halide emulsions used may have any grain size distribution. Silver halide emulsions which have a wide grain size distribution (referred to as polydisperse emulsions) may be used and emulsions which have a narrow grain size distribution (referred to as monodisperse emulsion) can be used individually, or a plurality of monodisperse emulsion can be used in the form of a mixture. (Here, a monodisperse emulsion is an emulsion in which the value obtained on dividing the standard deviation of the grain size distribution by the average grain size is not more than 0.20. In this connection, the gain size is taken to be the diameter of the grain in the case of a spherical silver halide grain, or the diameter of a circle of the same area as the projected image of the grain in the case of a grain which has a form other than a spherical form.) Furthermore, mixtures of monodisperse emulsions and polydisperse emulsions can also be used.

Furthermore, the emulsions used in the present invention may be mixed emulsions comprising a photosensitive silver halide emulsion and an internally fogged silver halide emulsion, or a combination of such emulsions may be used in combination in separate layers, as disclosed in U.S. Pat Nos. 2,996,383, 3,397,987 and 3,705,858. Here, the combined use of the mercapto compounds disclosed in JP-A-61-48832 is desirable to suppress fogging and to improve ageing and storage properties.

Various compounds can be present in the photographic emulsions used in the present invention to prevent the occurrence of fogging during manufacture, storage or photographic processing of the photographic material, or to stabilize photographic performance. Thus, many compounds which are known as antifogging agents or stabilizers, such as azoles, for example, benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5- mercaptotetrazole); mercaptopyrimidines; mercaptotriazines, thioketo compounds such as oxazolinethione, for example; azaindenes, for example, triazaindenes, tetraazaindenes (especially 4-hydroxy substituted (1,3,3a,7) tetraazaindenes) and pentaazaindenes; benzenethiosulfonic acid, benzenesulfinic acid and benzenesulfonic acid amide, for example, can be used for this purpose.

Polymer latexes well known in the industry, such as the homopolymers or copolymers of alkyl acrylates and copolymers of vinylidene chloride, can be present in the hydrophilic colloid layers of photographic sensitive materials of the present invention. The polymer latex may be pre-stabilized with nonionic surfactants as disclosed in JP-A-61-230136.

Poly(alkylene oxide) or the ether, ester or amine derivatives thereof, thioether compounds, thiomorpholines, quaternary ammonium salt compounds, urethane derivatives, urea derivatives, imidazole derivatives and 3-pyrazolidones, for example, may be included in the photographic emulsion layers of the photographic materials of the present invention to increase photographic speed, increase contrast or accelerate development.

The photographic emulsions used in the present invention may be spectrally sensitized using methine dyes or by other means. Suitable dyes which can be used include cyanine dyes, merocyanine dyes, complex cyanine dyes, complex merocyanine dyes, holopolar cyanine dyes, hemi-cyanine dyes, styryl dyes and hemioxonol dyes. Dyes classified as cyanine dyes, merocyanine dyes and complex cyanine dyes are especially useful in the present invention.

An antihalation layer can be established on the supports which are used in the present invention. Carbon black or various dyes, for example, oxonol dyes, azo dyes, arylidene dyes, styryl dyes, anthraquinone dyes, merocyanine dyes and tri- (or di-) allylmethane dyes, for example, can be used for this purpose. In this case, a cationic polymer or latex may be used in combination to prevent the dye from diffusing out of the anti-halation layer.

These materials are described in *Research Disclosure* volume 176, No. 17643, section VIII. Furthermore, magenta dyes disclosed in JP-A-61-285445 may be used to improve the tone of the silver image.

So-called matting agents, such as colloidal silica or barium strontium sulfate, poly(methyl methacrylate), methyl methacrylate/methacrylic acid copolymers, the methyl methacrylate/styrenesulfonic acid copolymers disclosed in JP-A-63-216046 or the particles which contain fluorine groups disclosed in JP-A-61-230136, for example, can be used in the hydrophilic colloid layers which are present in the present invention.

Inorganic or organic film hardening agents may be present in the photographic emulsion layers and other structural layers of a photographic material of the present invention. For example, aldehydes (e.g., formaldehyde, glyoxal, glutaraldehyde), active vinyl compounds (e.g., 1,3,5-triacryloyl-hexahydro-s-triazine, 1,3-vinylsulfonyl-2-propanol), active halogen compounds (e.g., 2,4-dichloro-6-hydroxy-s-triazine) or mucohalogen acids (e.g., mucochloric acid, mucophenoxychloric acid), either individually or in combinations can be used.

Vinylsulfone based compounds represented by the formula indicated below are preferred as film hardening agents.

$$(CH_2{=}CH{-}SO_2{-}CH_2)_2{-}A$$

In this formula, A represents a divalent group, or a direct bond.

Developing agents can be present in the photographic material of the present invention. Those disclosed in *Research Disclosure* volume 176, page 29 in the section of "Developing Agents" can be used in this way. The use of hydroquinone and pyrazolidones is especially desirable.

Couplers which form yellow, cyan and magenta colors can be used in the present invention, and details thereof are disclosed, for example, in JP-A-62-215272.

The photographic material of the present invention can be subjected to development processing of the type which results in the formation of a silver image (black and white development) or to development processing of the type which results in the formation of a colored image. Where an image is formed by means of a reversal process, a black- and white-negative development process is carried out initially, followed by a white light exposure or treatment in a bath which contains a fogging agent, and a color development process. Furthermore, the silver dye-bleach method in which dyes are present in the photographic material, the exposed material is subjected .to a black-and-white development process to form a silver image and the dyes ar subsequently bleached using the silver image as a bleaching catalyst can also be used.)

Black-and-white development processing generally comprises a development process, a fixing process and a water washing process. A stop process may be employed after the development process, and the water washing process can be omitted where a stabilizing process is carried out following the fixing process. Furthermore, developing agents or precursors thereof may be present in the photographic material and development processing can then be carried out using only an alkali bath. Development may also be carried out using lith developer for the development bath.

Color development processing is generally carried out using the methods disclosed in *Research Disclosure,* No. 17643, pages 28–29, and ibid, No. 18716, left and right hand columns of page 615. For example, this processing involves a color development process, a bleaching process, a fixing process, a water washing process and, as required, a stabilizing process. A bleach-fix process in which a bleach-fix bath is used can be employed in place of the process in which a bleach bath is used and the process in which a fixing bath is used, and any combination of bleaching process, fixing process and bleach-fix process can be used. Furthermore, monobath processing in which development, bleaching and fixing are carried out in a single bath can also be used. Film pre-hardening processes, and neutralizing processes, stop fixing processes and film post-hardening processes, can be carried out in combination with these processing operations. Water washing processes can be employed between the processes described above. Color developing agents or precursors thereof can be included in the material, and activator processing in which the development processing is carried out in a activator bath can be used instead of the color development processing operation in these processing procedures, and activator processing can be applied to monobath processing.

The usual known black-and-white development baths can be used for the black-and-white development processing of the black-and-white photographic materials, and the various additives generally added to black and white development baths can be present.

Typical additives include developing agents such as 1-phenyl-3-pyrazolidone, metol and hydroquinone; preservatives such as sulfites, promotors comprised of alkalis such as sodium hydroxide, sodium carbonate and potassium carbonate; inorganic and organic inhibitors such as potassium bromide, 2-methylbenzimidazole and methylbenzthiazole; hard water softening agents such as polyphosphates; and surface super-development inhibitors such as mercapto compounds and trace amounts of iodide.

The color development bath used for color development processing is preferably an aqueous alkaline solution which contains a primary aromatic amine based color developing agent as the principal component. Aminophenol based compounds can also be used as color developing agents, but the use of p-phenylenediamine based compounds is preferred. Typical examples include 3-methyl-4-amino-N-ethyl-N-$\beta$hydroxyethylaniline, 3-methyl-4-amino-N-ethyl-N-$\beta$-methanesulfonamidoethylaniline, and their sulfate salts.

The color development bath may contain pH buffers, such as alkali metal carbonates, borates or phosphates; development inhibitors or antifoggants such as bromide, iodide, benzimidazoles, benzothiazoles or mercapto compounds; various preservatives such as hydroxylamine, diethylhydroxylamine, sulfite hydrazines, phenylsemicarbazides, triethanolamine and catecholsulfonic acids; organic solvents such as ethylene glycol and diethylene glycol; development accelerators such as benzyl alcohol, polyethylene glycol, quaternary ammonium salts and amines; dye forming couplers; competitive couplers; fogging agents such as sodium borohydride; auxiliary developing agents such as 1-phenyl-3-pyrazolidone; thickeners; various chelating agents such as aminopolycarboxylic acids, aminopolyphosphonic acids, alkylphosphonic acids and phosphonocarboxylic acids; fluorescent whiteners such as 4,4'-diamino-2,2,-disulfostilbene based compounds; and various surfactants such as alkylsulfonic acids, arylsulfonic acids, aliphatic carboxylic acids and aromatic carboxylic acids.

Compounds of polyvalent metals such as iron(III), cobalt(III), chromium(IV) and copper (II), peracids; quinones and nitro compounds, for example, can be used as bleaching agents in the bleach baths and bleach-fix baths. Typical bleaching agents include ferricyanide; dichromates; organic complex salts of iron(III) and cobalt(II), for example, complex salts with aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid and glycol ether diaminotetraacetic acid, or citric acid, tartaric acid or malic acid for example; persulfate; bromate; permanganate and nitrobenzenes.

Known additives including re-halogenating agents such as ammonium bromide and ammonium chloride, pH buffers such as ammonium nitrate and agents for the prevention of metal corrosion such as ammonium sulfate can be added to the bleach bath or bleach-fix bath.

Thiosulfate, thiocyanate, thioether based compounds, thioureas and large quantities of iodide, for example, can be used as fixing agents in the fixing baths and bleach-fix baths. Ammonium thiosulfate is especially desirable from the point of view of solubility and fixing rate. Sulfite or bisulfite, and carbonyl/bisulfite addition compounds or sulfinic acid compounds are preferred as preservatives for bleach-fix baths. The presence of aminopolycarboxylic acids and organosulfonic acid based chelating agents (preferably 1-hydroxyethylidene-1,1-diphosphonic acid and N,N,N',N'-ethylenediamine tetraphosphonic acid) in the fixer bath is desirable for improving fixer bath stability.

Moreover, various fluorescent whiteners, defoaming agents, surfactants, polyvinylpyrrolidone and methanol, for example, can be present in a fixer bath or bleach-fix bath.

The processing temperature for each process can be within the range from 10° C. to 65° C., and temperatures in excess of 65° C. can be used, if desired. Processing is preferably carried out in the temperature range from 25° C. to 45° C.

Furthermore, shortening of the development processing time is being actively pursued with various photographic materials, especially X-ray materials. Moreover, simplified means of processing are also being developed, and when the polymer compounds of the present invention are used it is possible to provide photographic materials which are especially good for use with these latest techniques.

The invention is illustrated by means of the examples set forth below, but the invention is not to be construed as being limited by these examples.

EXAMPLE 1

(1-1) Support Preparation

Vinylidene chloride/itaconic acid copolymer (polymerization mol ratio 97:3) and dichlorohydroxytriazine sodium salt (0.03 g/m$^2$) were coated onto both sides of a poly(ethylene terephthalate) (PET) film to provide a poly(ethylene terephthalate) support which had been biaxially stretched at 220° C. (PET thickness 175 μm, vinylidene chloride copolymer layer thickness 0.7 μm). One surface of the support was subjected to a corona discharge and then coated using a bar coater with a liquid comprised of the compounds (P-1, P-2, P-8, P-10, P-24, P-25) indicated in Table 1 and 10 mg/m$^2$ of a sensitizing agent (3,3-carbonyl-bis(7-diethylaminocoumarin), after which it was dried at 140° C. A subbing layer was formed in each case by irradiating for 60 seconds using a 5 kw mercury lamp. This was subjected to a corona discharge treatment and overcoated with 0.002 g/m$^2$ of sodium α-sulfodihexylsuccinate, 0.02 g/m$^2$ of poly(styrene/divinyl benzene) (polymerization ratio 98:2, average particle size 2.0 μm) and 0.005 g/m$^2$ of 1,3-divinylsulfonyl-2-propanol to form a subbing layer protecting layer.

Furthermore, the subbing layer protecting layer alone was produced without providing the subbing layer in the case of the control (1-1). On the other hand with the comparative samples (1-8 and 1-12), the aforementioned vinylidene chloride layer was formed and subjected to a corona discharge treatment, after which the layer was coated with a liquid obtained by adding the comparative compounds shown in Table 1 below to an aqueous solution comprising gelatin (0.06 g$^2$), 2,4-dichloro-6-hydroxytriazine, sodium salt (0.005 g/m$^2$) and p-octylphenoxy polyoxyethylene ether (degree of polymerization 10) (0.003 g/m$^2$) and dried to forma subbing layer, which was subsequently coated over with a subbing layer protecting layer in the same way as the samples of the present invention. Only the subbing layer protecting layer was established on one side.

Moreover, comparative samples (1-9) to 1-11) were prepared in exactly the same way as the samples of the invention (for example, 1-2).

(1-2) Dye Layer Structure

Preparation of Fine crystalline Dye Dispersion

The dye indicated below was ball milled in accordance with the method outlined below. Thus, water (21.7 ml) and a 6.7% aqueous solution of Triton X-200 ®(2.65 grams, sodium salt of alkyl aryl polyether sulfonated made by Rohm & Haas) were introduced into a 60 ml screw capped bottle. The dye indicated below (1.00 gram) was added to this solution. Zirconium oxide (ZrO)beads (2 mm diameter) (40 ml) were added. The container was tightened and placed in a mill and the contents were pulverized for a period of 4 days. The container was then removed and the contents were added to a 12.5% aqueous gelatin solution (8.0 grams). The mixture was left for 10 minutes in a roll mill and de-gassed, and then the mixture obtained was filtered and ZrO beads were removed.

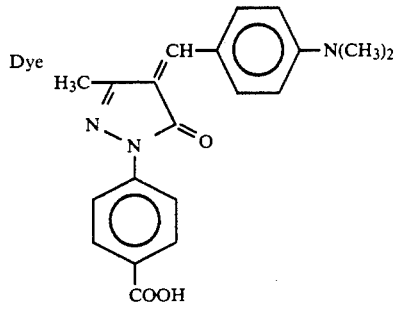

Coating Procedure

Surfactant (sodium p-octylphenylethoxyethoxyethanesulfonate) and film hardening agent (bis-(vinylsulfonylmethyl) ether) were added to the dye-gelatin melt described above. The melt produced from the latter mixture was then coated onto both sides of the aforementioned support in such a way that the coated weight of dye was 0.08 g/m$^2$, the coated weight of gelatin was 0.4 g/m$^2$, the coated weight of surfactant was 0.026 g/m$^2$ and the coated weight of film hardening agent was 0.016 g/m$^2$.

(1-3) Emulsion Layer Structure

Gelatin (30 grams), 5 grams of potassium bromide and 0.05 grams of potassium iodide were added to 1 liter of water and an aqueous solution of silver nitrate (5 grams as silver nitrate) and an aqueous solution of potassium bromide containing 0.73 gram of silver iodide were added using the double jet method over a period of 1 minute, with agitation, to the container which was maintained at 75° C. Moreover, an aqueous solution of potassium nitrate (145 grams as silver nitrate) and an aqueous solution of potassium bromide were added using the double jet method. The rate of addition at this time was accelerated in such a way that the flow rate at the end of the addition was eight times the flow rate at the beginning of the addition. Subsequently, 0.37 gram of aqueous potassium iodide solution was added.

After the addition had been completed and the soluble salts had been removed using the precipitation method at 35° C., the mixture was warmed to 40° C., 60 grams of gelatin was added and the pH was adjusted to 6.5. The temperature was then raised again to 56+ C. and, after adding 650 mg of the sensitizing dye anhydro-5,6'-dichloro-9-ethyl-3,3'-di(3-sulfopropyl)oxacarbocyaninehydroxide, sodium salt, the emulsion was chemically sensitized with the combined use of gold and sulfur sensitization. The emulsion so obtained comprised hexagonal tubular grains which had a projected area diameter of 0.85 μm and an average thickness of 0.158 μm.

Stabilizers 4-hydroxy-6-methyl-1,3,3a, 7-tetraazaindene and 2,6- bis(hydroxyamino)-4-diethylamino-1,3,5-triazine and trimethylolpropane were added to this emulsion.

Moreover, the compound indicated below (350 mg/m$^2$) was also added.

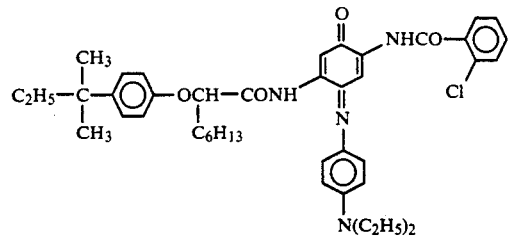

Further, sodium p-octylphenoxyethoxyethanesulfonate (0.01 g/m$^2$) and dodecylbenzene sulfonate (0.005 g/m$^2$) were added as surfactants, poly (potassium p-vinylbenzenesulfonate) (0.03 g/m$^2$) and a polymer latex (poly(ethyl acrylate/methacrylic acid=97/3) grains on which poly(degree of polymerization 10) oxyethylene poly(degree of polymerization 3) oxyglyceryl dodecyl ether, 3 wt% of the particles) had been adsorbed, average particle diameter=0.1 μm)(0.4 g/m$^2$), sodium polyacrylate (molecular weight 200,000 (0.1 g/m$^2$), 1,2-bis(-vinylsulfonylacetamido)ethane (0.04 g/m$^2$) and trimethylol were added as thckeners.

(1-4) Protective Layer Structure

| | |
|---|---|
| Gelatin | 1.2 g/m$^2$ |
| Polyacrylamide (molecular weight 45,000 | 0.2 g/m$^2$ |
| Dextran (molecular weight 38,000) | 0.2 g/m$^2$ |
| Sodium polyacrylate | 0.02 g/m$^2$ |
| Sodium polyacrylate | 0.02 g/m$^2$ |
| Sodium polystyrenesulfonate | 0.01 g/m$^2$ |
| Colloidal silica (particle size 0.02 μm) | 0.04 g/m$^2$ |
| Poly (degree of polymerization 10) oxyethylene cetyl ether | 0.02 g/m$^2$ |
| Poly (degree of polymerization 10) oxyethylene poly (degree of polymerization 3) glyceryl-p-octylphenyl ether | 0.02 g/m$^2$ |
| Finisher: Page 69 | |
| $C_8H_{17}SO_2N(C_3H_7)-(CH_2CH_2O)_4-(CH_2)_4SO_3Na$ | 0.001 g/m$^2$ |
| $C_9F_{19}O-C_6H_4-SO_2NH(CH_2)_2\overset{\oplus}{N}(CH_3)_3.I^{\ominus}$ | 0.0005 g/m$^2$ |
| $C_9F_{19}CONH-(CH_2)_3-{}^{+}N(CH_3)_2-CH_2COO^{-}$ | 0.001 g/m$^2$ |
| $C_8F_{17}SO_2N(C_3H_7)-(CH_2CH_2O)_{10}-(CH_2CH(OH)CH_2O)_3-H$ | 0.005 g/m$^2$ |
| $C_9H_{19}-C_6H_4-O(CH_2CH(OH)CH_2O)_3(CH_2)_4SO_3K$ | 0.01 g/m$^2$ |
| Potassium nitrate | 0.05 g/m$^2$ |
| Sodium p-tert-octylphenoxyethoxyethoxyethanesulfonate | 0.02 g/m$^2$ |
| 4-Hydroxy-6-methyl-1,3,3a,7-tetraazaindene | 0.04 g/m$^2$ |
| Cetyl palmitate (particle size 0.11 μm, dispersed with sodium dodecylbenzenesulfonate) | 0.005 g/m$^2$ |
| Dimethylsiloxane (particle size 0.12 μm, dispersed with sodium dioctyl-α-sulfo- | 0.005 g/m$^2$ |

-continued

| | |
|---|---|
| succinate) | |
| Liquid paraffin (Particle size 0.11 μm, dispersed in sodium dioctyl-α-sulfo-succinate | 0.005 g/m$^2$ |
| Fine poly(methyl methacrylate) particles (average particle size 3.8 μm, at least 80% from 4.8 to 2.8μ) | 0.04 g/m$^2$ |
| Fine polystrene particles (average particle size 0.6 μm) | 0.1 g/m$^2$ |

Solutions where were prepared in such a way that the gelatin concentration was 4 wt% in each case to provide the basic formulations for the above mentioned emulsion and protective layers.

Thus, the liquids were coated onto both sides of the support prepared in (1-1) to provide a coated silver weight of 1.9 g/m$^2$ on each side. Furthermore, coating was carried out in such a way that the layer arrangement from the side nearest the support was dye layer - emulsion layer - protective layer.

The samples prepared in the way shown in Table 1 below were evaluated.

The development bath, fixer bath and the development processing conditions were as indicated below.

| Development Bath Concentrate | |
|---|---|
| Potassium hydroxide | 56.6 grams |
| Sodium sulfite | 200 grams |
| Diethylenetriaminepentaacetic acid | 6.7 grams |
| Potassium carbonate | 16.7 grams |
| Boric acid | 10 grams |
| Hydroquinone | 83.3 grams |
| Diethylene glycol | 40 grams |
| 4-Hydroxymethyl-4-methyl-1-phenyl-3-pyrazolidone | 11.0 grams |
| 5-Methylbenzotriazole | 2 grams |
| Water to make | 1 liter |
| (The pH was adjusted to 10.60) | |

| Fixer Concentrate | |
|---|---|
| Ammonium thiosulfate | 560 grams |
| Sodium sulfite | 60 grams |
| Ethylenediaminetetraacetic acid, di-sodium salt, dihydrate | 0.10 gram |
| Sodium hydroxide | 24 grams |
| Water to make | 1 liter |
| (The pH was adjusted to 5.10 with acetic acid) | |

| Processing Step | Temperature | Processing Time |
|---|---|---|
| Development | 35° C. | 10.5 seconds |
| Fixing | 35° C. | 9 seconds |
| Water Washing | 20° C. | 7.5 seconds |
| Drying | 50° C. | |
| Dry to Dry Processing Time: | | 45 seconds |

Each processing tank was filled in the manner indicated below at the start of development processing.

Developing Tank (6.5 liters): 333 ml of the developer concentrate described above, 667 ml of water and 10 ml of a starter which contained 2 grams of potassium bromide and 1.8 grams of acetic acid were added and the pH was set at 10.15.

Fixer Tank (6.5 liters): 250 ml of the fixer concentrate described above and 750 ml of water.

(1) Static Mark Test

The unexposed samples were conditioned in terms of moisture by standing by 2 hours under conditions of 25° C., 10% RH and then they were rubbed with a rubber roller and a urethane roller in a dark room under the conditions aforementioned, after which they were developed in the development bath described above, fixed and washed in order to investigate to what extent static marks had been formed in these materials.

The evaluation of static mark formation was made in accordance with the four levels indicated below.

A: No static marks formed.

B: A few static marks formed.

C: Quite a lot of static marks formed.

D: Static marks formed over almost the whole surface.

(2) Dust Attachment Test

Samples (20 cm×20 cm) were rubbed with gauze under conditions of 25° C., 10% RH and the attachment of cigarette ash was investigated. The evaluation was carried out in respect of the four levels indicated below.

A: No attachment of cigarette ash at all.

B: Slight attachment of cigarette ash.

C: Some attachment of cigarette ash.

D: Very considerable attachment of cigarette ash.

(3) Adhesion Tests

The finished samples were left to stand for 2 weeks in an atmosphere at 25° C., 50% RH and then the adhesion properties were tested using the methods outlined below. Here, the surface tested was that on which the base anti-static layers A to G had been established.

(i) Adhesion Tests of Dry Films

Seven cuts were made both length wise and transversely with a spacing of 5 mm in the surface to be tested to provide 36 squares, a sticky-tape (for example, "Nitto Tape" made by Nitto Kenki Kogyo (Co.)) was stuck on the top and then peeled away sharply in a 180° direction. The samples with which the unpeeled part was at least 90% when this procedure was followed were designated as grade A, those where the unpeeled part was at least 60% were designated as grade B and those where the unpeeled part was less than 60% were designated as grade C. Those designated as grade A of the three levels of evaluation indicated above had an adhesive strength sufficient for practical use as a photographic material.

(ii) Adhesion Test for Wet Films

Scratches in the form of an x were made using a pencil in the film in the processing bath at each of the development, and fixing and washing stages and this was rubbed vigorously five times with a finger tip. The strength of adhesion was evaluated by means of the maximum width of peeling from the lines of the x.

Those cases where there was no peeling of the structural layers over the scratches were designated as grade A, those where the maximum width of peeling was within 5 mm were designated as grade B and the others were designated as grade C. Those designated as at least grade B, and preferably grade A, of the three levels of evaluation indicated above, had sufficient adhesive strength to be of practical use as photographic materials.

(4) Evaluation of Fixer Bath Contamination

Five hundred samples measuring 25 cm×30 cm which had been infrared exposed to provide a density of 1.5 on a Macbeth densiotometer were developed and processed using freshly prepared developer and fixer. The insoluble material suspended in the fixer bath was then assessed in accordance with the four levels indicated below.

The rates of replenishment of the developer and the fixer were 50 cc per sheet and 60 cc per sheet, respectively.

A: No suspended matter at all.
B: A little suspended matter.
C: Quite a lot of suspended matter.
D: Very much suspended matter.

It is clear from the results in Table 1 that the control sample 1-1 which did not contain a polymer compound of the present invention was very poor in both the extent of static mark formation and the attachment of dust. On the other hand, samples 1-2 to 1-7 in which polymer compounds of the present invention had been used resolved the problems of dust attachment and fixing bath contamination at the same time and were excellent in all of the other evaluations conducted. In contrast comparative sample 1-8 had poor fixing bath contamination and adhesion properties, and, after processing samples 1-9 to 1-12 in which comparative electrically conductive polymers were used were poor with respect to static marks and the attachment of dust, poor with respect to fixing bath contamination and adhesion properties, and poor with respect to the state of the coated surface.

TABLE 1

| Sample | Compound Added to Subbing Layer (g/$^2$) | Static Marks | | Attachment of Dust | | Adhesion | | Fixer Bath Contamination |
|---|---|---|---|---|---|---|---|---|
| | | Rubber | Urethane | Before Development | After Development | Dry Film | Wet Film | |
| 1-1 (Control) | — | A | C | C | D | A | A | A |
| 1-2 (Invent.) | P-1 (0.02) | A | A | A | A | A | B | A |
| 1-3 (Invent.) | P-2 (0.02) | A | A | A | A | A | B | A-B |
| 1-4 (Invent.) | P-8 (0.02) | A | A-B | A | B | A | B | A-B |
| 1-5 (Invent.) | P-10 (0.02) | A | A | A | A | A | A | A |
| 1-6 (Invent.) | P-24 (0.02) | A | A | A | A | B | A | A |
| 1-7 (Invent.) | P-25 (0.02) | A | A | A | A | A | A | A-B |
| 1-8 (Comp.) | $SnO_2$/Pb (80/20) particles, diam. 0.15μ (0.02) | A | A | A | A | B | B | C |
| 1-9 (Comp) | Comp. Cpd. 1 (0.02) | A | A | B | C | C | C | C |
| 1-10 (Comp) | Comp. Cpd. 2 (0.02) | A | B | B | D | C | C | D |
| 1-11 (Comp) | Comp. Cpd. 3 (0.02) | A | A | B | C | B | C | C |
| 1-12 (Comp) | Sodium polystyrene-sulfonate (0.02) | B | C | B | D | C | C | D |

The surface condition of each of samples 1-9 to 1-12 was poor.

Comparative Compound 1

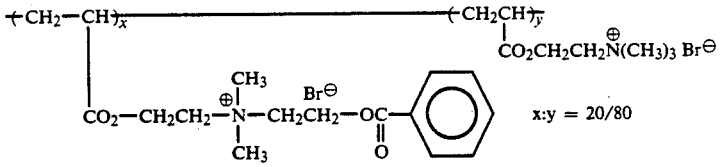

x:y = 20/80

Comparative Compound 2

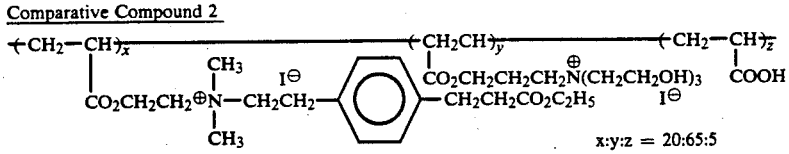

x:y:z = 20:65:5

Comparative Compound 3

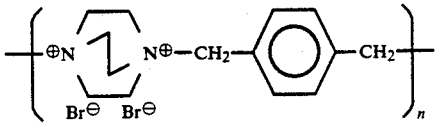

Mw ≈ 25,000

Moreover, sample 1-8 had inferior transparency when compared with the other samples when measured in accordance with ASTM D-1003.

Moreover, excellent images were obtained with both the control sample and the samples of the present invention.

EXAMPLE 2

(2-1) Silver Halide Emulsion Layer Formulation

An aqueous solution of silver nitrate and a mixed aqueous solution of sodium chloride and potassium bromide were added simultaneously at a constant rate over a period of 30 minutes in the presences of $2\times10^{-5}$ mol per mol·Ag, of rhodium chloride to an aqueous gelatin solution which was maintained at 50° C. to prepare a monodisperse silver chlorobromide emulsion of average grain size 0.2 μ (chlorine content 95 mol%).

This emulsion was desalted using a flocculation method, 1 mg/mol·Ag of thiourea dioxide and 0.6 mg/mol·Ag of chloroauric acid were added and the mixture was ripened at 65° C. to provide maximum performance and fogging was produced.

The compounds indicated below were added to the emulsion so obtained.

| | |
|---|---|
| 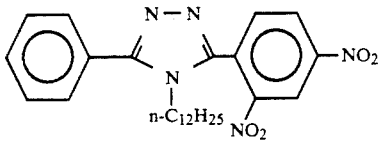 | $2\times10^{-2}$ mol/mol · Ag |
| 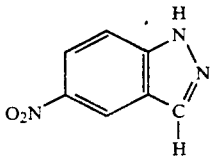 | $1\times10^{-3}$ mol/mol · Ag |
| 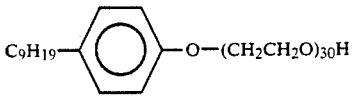 | $4\times10^{-4}$ mol/mol · Ag |
| KBr | 20 mg/m$^2$ |
| Sodium polystyrenesulfonate | 40 mg/m$^2$ |
| Sodium salt of 2,6-Dichloro-6-hydroxy-1,3,5-triazine | 30 mg/m$^2$ |

This coating liquid was coated to provide a coated silver weight of 3.5 g/m$^2$.

(2-2) Emulsion Protecting Layer Formulation

The compounds indicated below were added to the protective layer of Example 1. Moreover, the gelatin content was set at 1.5 g/m$^2$.

| | |
|---|---|
| Sodium dodecylbenzenesulfonate | 0.05 g/m$^2$ |
| Sodium acetate | 0.03 g/m$^2$ |
| 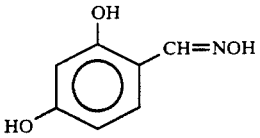 | 0.02 g/m$^2$ |
| 5-Nitroindazole | 0.015 g/m$^2$ |
| 1,3-Divinylsulfonyl-2-propanol | 0.05 g/m$^2$ |
| Potassium salt of N-perfluoro-octanesulfonyl-N-propylglycine | 2 mg/m$^2$ |
| Ethyl acrylate latex (average particle size 0.1μ) | 0.2 g/m$^2$ |
| 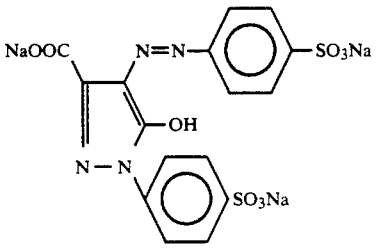 | 0.1 g/m$^2$ |

(2-3) Formulation of Back Subbing Layer

| | |
|---|---|
| Gelatin | 0.01 g/m$^2$ |
| Poly(ethyl acrylate) latex (particle size 0.6 μm) | 0.005 g/m$^2$ |
| 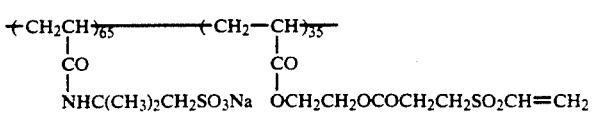 | 0.003 g/m$^2$ |

(2-4) Backing Layer Formulation

| | |
|---|---|
| Gelatin | 2.5 g/m$^2$ |
| 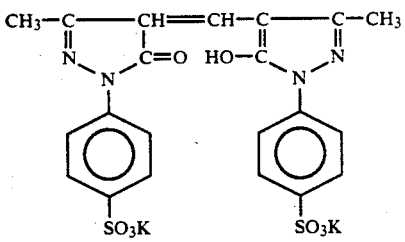 | 30 mg/m$^2$ |
| 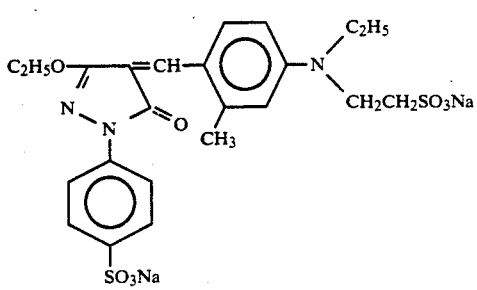 | 140 mg/m$^2$ |
| 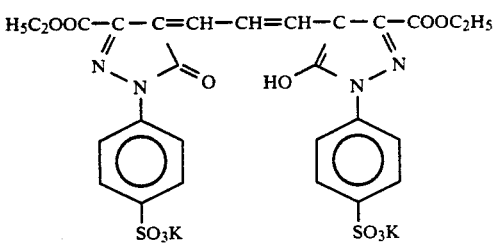 | 40 mg/m$^2$ |
| 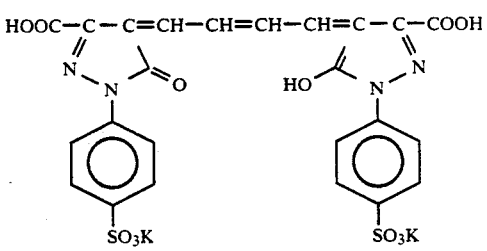 | 80 mg/m$^2$ |
| 1,3-Divinylsulfonyl-2-propanol | 150 mg/m$^2$ |
| Ethyl acrylate latex (average particle size 0.1μ) | 900 mg/m$^2$ |
| Sodium dihexyl-α-sulfosuccinate | 35 mg/m$^2$ |
| Sodium dodecylbenzenesulfonate | 35 mg/m$^2$ |

(2-5) Back Protecting Layer Formulation

This was prepared in the same way as in Example 1. Moreover, the gelatin content was set at 1.0 g/m$^2$.

The coated samples were prepared by incorporating the compounds (P-3, P-11, P-12, P-13, P-21) shown in table 2 and a sensitizer (2-(p-chlorobenzoyl)naphthothiazole, 10 mg/m$^2$) in a subbing layer on the aforementioned PET support using the same method as used for the preparation in Example 1, coating the backing subbing layer and the back protecting layer sequentially at the same time on one of the subbing layer coated surfaces, and coating the emulsion layer and the emulsion protecting layer on the other side. The results obtained on evaluating the samples so obtained are shown in Table 2.

TABLE 2

| Sample | Compound Added to Back Subbing Layer (g/$^2$) | Static Marks | | Attachment of Dust | | Adhesion | | Fixer Bath Contamination |
|---|---|---|---|---|---|---|---|---|
| | | Rubber | Urethane | Before Development | After Development | Dry Film | Wet Film | |
| 2-1 (Control) | — | A | C | C | D | A | A | A |
| 2-2 (Invent.) | P-3 (0.02) | A | A | A | A | A | B | A |

TABLE 2-continued

| Sample | Compound Added to Back Subbing Layer (g/2) | Static Marks Rubber | Static Marks Urethane | Attachment of Dust Before Development | Attachment of Dust After Development | Adhesion Dry Film | Adhesion Wet Film | Fixer Bath Contamination |
|---|---|---|---|---|---|---|---|---|
| 2-3 (Invent.) | P-11 (0.02) | A | A | A | A | A | A | A |
| 2-4 (Invent.) | P-12 (0.02) | A | A | A | A | A | A | A-B |
| 2-5 (Invent.) | P-13 (0.02) | A | A | A | A | A | A | A-B |
| 2-6 (Invent.) | P-21 (0.02) | A | A | A | A | B | A | A |
| 1-7 (Comp.) | $SnO_2$/Pb (80/20) particles, diam. 0.15μ (0.02) | A | A | A | A | B | C | C |
| 2-8 (Comp) | Comp. Cpd. 1 (0.02) | A | A | B | D | C | C | C |
| 2-9 (Comp) | Comp. Cpd. 2 (0.02) | A | B | B | D | C | C | D |
| 2-10 (Comp) | Comp. Cpd. 3 (0.02) | A | A | B | D | C | C | C |
| 1-11 (Comp) | Sodium polystyrene-sulfonate (0.02) | B | C | C | D | C | C | D |

The surface condition of each of samples 2-8 to 2-12 was poor.

It is clear from the results in Table 2 that samples 2-2 to 2-6 prepared using polymer compounds of the present invention were excellent in respect to the extent of static mark formation, the attachment of dust and fixing bath contamination properties, and they also provided excellent coating properties and adhesion properties.

On the other hand, the control sample 1-1 and samples 2-7 to 2-11 in which comparative electrically conductive agents were used were cannot meet all the properties in respect to static marks, the attachment of dust, fixing bath contamination properties, coating properties and adhesion properties.

EXAMPLE 3

Color photographic negative film samples 3-1 to 3-6 were prepared in the same way as in Example 2 except that the emulsion layer which contained tabular type silver halide grains was replaced with layers with the composition of the first to the fourteenth layers of the photosensitive layer of sample 202 in illustrative example 3 of JP-A-63-264740, and these samples were evaluated in the same way as before. Processing was carried out in the same way as described in JP-A-63-264740.

Samples 3-2 to 3-6 of the present invention were all satisfactory in respect of static marks, the attachment of dust, fixing bath contamination, coating properties and adhesion properties.

On the other hand, comparative samples 3-7 to 3-11 and the control sample 3-1 were all unsatisfactory in terms of the above mentioned performance.

EXAMPLE 4

The photosensitive layer composition of sample 104 of illustrative example 2 of JP-A-63-264740 was coated on one side of a cellulose triacetate support. Details of the composition of the backing layer coated on the other side are indicated below.

| | |
|---|---|
| First Backing Layer | |
| Compound of the present invention (same compound and sensitizer, and amounts added, as in Example 1) | |
| Diethylene glycol | 10 mg/m$^2$ |
| (These were coated using an acetone/methanol/water mixed solvent and then irradiated for 60 seconds using a 5 kw mercury lamp in the same way as described in example 1.) | |
| Second Backing Layer | |

-continued

| | |
|---|---|
| Diacetylcellulose | 200 mg/m$^2$ |
| Stearic acid | 10 mg/m$^2$ |
| Cetyl stearate | 20 mg/m$^2$ |
| Silica particles (particle size 0.3 μm) (Coated using an acetone/methanol/water mixed solvent) | 30 mg/m$^2$ |

Processing was carried out as in illustrative example 2 of JP-A-63-264740.

The samples 4-1 to 4-12 so obtained were evaluated in the same way as described in Example 1 above.

Samples 4-2 to 4-7 of the present invention were satisfactory in respect to static marks, the attachment of dust, fixing bath contamination, coating properties and adhesion properties, and excellent images were obtained.

On the other hand, control sample 4-1 and comparative samples 4-8 to 4-12 were not satisfactory in all these respects.

EXAMPLE 5

Preparation of Methyl Methacrylate/Ethyl Acrylate/Acrylic Acid Copolymer

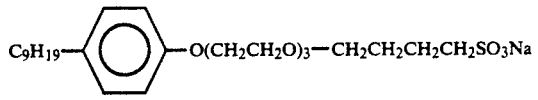

(1.5 grams) was introduced into a 1 liter three-necked flask provided with a stirring device and a reflux condenser, and the compound was dissolved in 300 cc of water. Next, the reactor was heated to 75° C. under a blanket of nitrogen and the contents were stirred at 200 rpm. At this stage, 40 grams of a 3% aqueous solution of potassium persulfate was added, and this was followed by the dropwise addition, over a period of 3 hours, of a mixed solution comprising 150 grams of methyl methacrylate, 87.5 grams of ethyl acrylate and 12.5 grams of acrylic acid. 10 grams of 3% potassium persulfate was added six times at 30 minute intervals after the start of the dropwise addition. The reactor was maintained at 75° C. for 2 hours after completing the dropwise addition of the monomer mixture and an aqueous dispersion of a copolymer of average molecular weight 250,000 was obtained. This aqueous dispersion was neutralized with a 10% aqueous potassium hydroxide solution and adjusted to pH 7.0.

Sodium salt of 2,4-dichloro-6-hydroxy-1,3,5-triazine was added at the rate of 4 wt% with respect to the copolymer to this aqueous dispersion of copolymer and the liquid obtained on adding fine polystyrene particles of average diameter 2 μ in such a way that the coated weight of fine polystyrene particles was 1.0 mg/m$^2$ was taken as the first subbing layer coating liquid.

A biaxially stretched polyethylene terephthalate film of thickness 100 μ and width 30 cm was subjected to a corona discharge treatment under the conditions indicated below. The film transport rate was 30 m/min, the gap between the corona discharge electrode and the polyethylene terephthalate film was 1.8 mm and the electrical power was 200 watts. The aqueous dispersion of copolymer prepared using the method described above was coated to provide a dry film thickness of 0.1 μm onto both sides of the polyethylene terephthalate film which had been subjected to the corona discharge treatment, and this was dried at 185° C. This layer is referred to hereinafter as the first subbing layer. This was subjected to a corona discharge treatment under conditions of film transport rate 30 m/min, gap between the corona discharge electrode and the polyethylene terephthalate film 1.8 mm, electrical power 200 watts, and an aqueous dispersion of a vinylidene chloride/methyl methacrylate/methyl acrylate/acrylonitrile/acrylic acid (90:4.5:4:1:0.5, wt%) copolymer was coated onto both sides in such a way as to provide a dry film thickness of 0.75 μm, and this was dried at 120° C. Moreover, one side of the second subbing layer which comprised this vinylidene chloride based copolymer was subjected to a corona discharge at a film transport rate of 30 m/min, a gap between the corona discharge electrode and the polyethylene terephthalate film of 1.8 mm and an electrical power of 250 watts and the subbing layer liquid of formulation (1) indicated below was coated onto this surface as a third subbing layer at a rate of 20 ml/m$^2$ and dried at 170° C. to provide a subbing layer on the emulsion side.

Next, a subbing layer as described in Example 1 above as the third subbing layer formulation and the subbing layer protecting layer were established on the other side to provide the backing side subbing layer.

Next, a silver halide emulsion layer of formulation (2) described below and an emulsion protecting layer of formulation (3) described below were coated onto the emulsion layer side subbing layer of the said support. A backing layer of formulation (4) described below and a backing protecting layer of formulation (5) described below were then coated sequentially from the support side over the backing layer subbing layer on the opposite side of the support to provide the samples 5-1 to 5-12.

(1) Third Subbing Layer Formulation

| | |
|---|---|
| Gelatin | 1.0 wt % |
| Methylcellulose | 0.05 wt % |
| Surfactant, $C_{12}H_{25}O(CH_2CH_2O)_{10}H$ | 0.03 wt % |
| Water to make | 100 wt % |

(2) Silver Halide Emulsion Layer Formulation

An aqueous solution of silver nitrate and a mixed aqueous solution of sodium chloride and potassium bromide were added simultaneously at a constant rate over a period of 30 minutes, in the presence of $2\times10^{-5}$ mol/mol·Ag of rhodium chloride, to an aqueous gelatin solution which was maintained at 50° C. to prepare a monodisperse silver chlorobromide emulsion of average grain size 0.2 μ (chlorine content 95 mol·%).

This emulsion was desalted using a flocculation method, 1 mg/mol·Ag of thiourea dioxide and 0.6 mg/mol·Ag of chloroauric acid were added and the mixture was ripened at 65° C. to provide the maximum performance and fogging was produced.

The compounds indicated below were added to the emulsion so obtained.

| | |
|---|---|
| 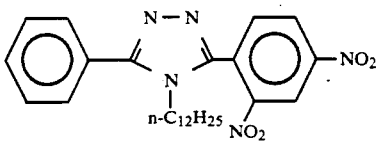 | $2\times10^{-2}$ mol/mol · Ag |
| 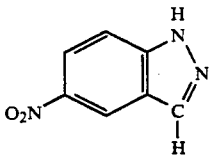 | $1\times10^{-3}$ mol/mol · Ag |
| 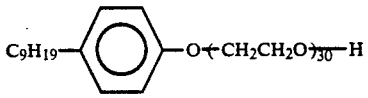 | $4\times10^{-4}$ mol/mol · Ag |
| KBr | 20 mg/m$^2$ |
| Sodium polystyrenesulfonate | 40 mg/m$^2$ |
| Sodium salts of 2,4-Dichloro-6-hydroxy-1,3,5-triazine | 30 mg/m$^2$ |

This coating liquid was coated in such a way as to provide a coated silver weight of 3.5 g/m$^2$.

| | |
|---|---|
| Gelatin | 1.5 g/m$^2$ |
| Fine $SiO_2$ particles (average particle size 4μ) | 50 mg/m$^2$ |

-continued

| | |
|---|---|
| Sodium dodecylbenzenesulfonate | 50 mg/m$^2$ |
| 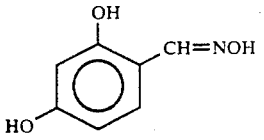 | 20 mg/m$^2$ |
| 5-Nitroindazole | 15 mg/m$^2$ |
| 1,3-Divinylsulfonyl-2-propanol | 50 mg/m$^2$ |
| Potassium salt of N-@erfluorooctane-sulfonyl-N-propylglycine | 2 mg/m$^2$ |
| Ethyl acrylate latex (average particle size 0.1μ) | 300 mg/m$^2$ |

-continued

| | |
|---|---|
| 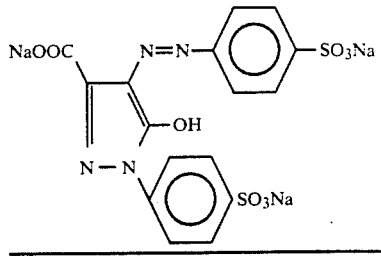 | 100 mg/m$^2$ |

(4) Backing Layer Formulation

| | |
|---|---|
| Gelatin | 2.5 g/m$^2$ |
| 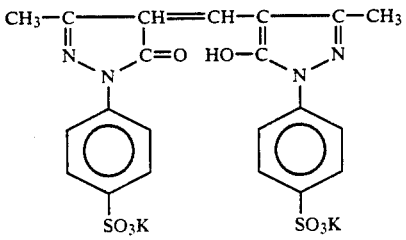 | 30 mg/m$^2$ |
| 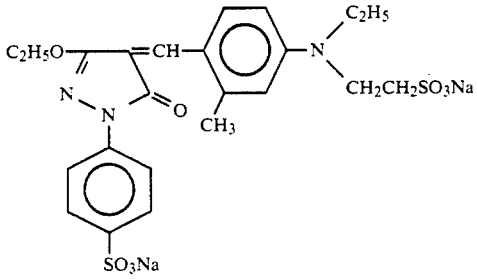 | 140 mg/m$^2$ |
| 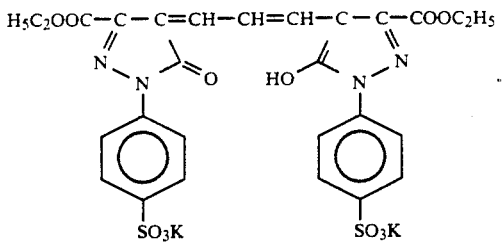 | 40 mg/m$^2$ |
| 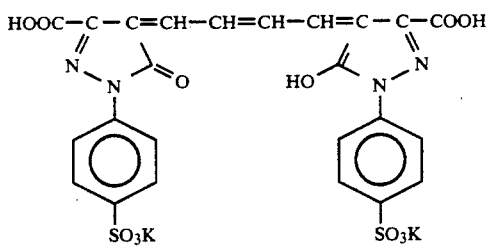 | 80 mg/m$^2$ |
| 1,3-Divinylsulfonyl-2-propanol | 150 mg/m$^2$ |
| Ethyl acrylate latex (average particle size 0.1μ) | 900 mg/m$^2$ |
| Sodium dihexyl-α-sulfosuccinate | 35 mg/m$^2$ |
| Sodium dodecylbenzenesulfonate | 35 mg/m$^2$ |

(5) Backing Protecting Layer Formulation

| | |
|---|---|
| Gelatin | 0.8 g/m$^2$ |
| Fine poly(methyl methacrylate) particles (average particle size 3$\mu$) | 20 mg/m$^2$ |
| Sodium dihexyl-$\alpha$-sulfosuccinate | 10 mg/m$^2$ |
| Sodium dodecylbenzenesulfonate | 10 mg/m$^2$ |
| Sodium acetate | 40 mg/m$^2$ |

Development processing was carried out using 38° C. and 20 second processing conditions in developer and fixer GRD-A1 and GRF-1 made by the Fuji Photo Film Co., Ltd. using an FG-606F model automatic processor made by Fuji Photo Film Co., Ltd. The drying temperature on this occasion was 45° C.

Samples 5-1 to 5-12 obtained were evaluated in the same way as described in Example 1 above.

Samples 5-2 to 5-7 of the present invention were all satisfactory in respect to static marks, the attachment of dust, fixer bath contamination, coating properties and adhesion properties, and they also provided excellent images.

On the other hand, control sample 5-1 and the comparative samples 5-8 to 5-12 unsatisfactory in all these respects and the present invention is clearly superior to the conventional technique.

While the invention has been described in detail and with reference to specific embodiments thereof, it will be apparent to one skilled in the art that various changes and modifications can be made therein without departing from the spirit and scope therefor.

What is claimed is:

1. A silver halide photographic material comprising a support having thereon at least one silver halide emulsion layer, wherein at least one of the layers of said photographic material is a layer which is crosslinked after coating a coating liquid comprising a polymeric compound which has at least repeating units represented by formula (I) or formula (II):

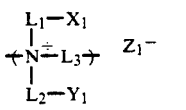

(I)

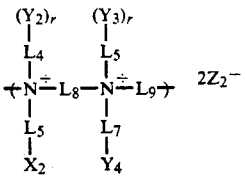

(II)

wherein, $L_1$, $L_2$, $L_3$, $L_4$, $L_5$, $L_6$, $L_7$, $L_8$ and $L_9$, which may be the same or different, each represents a divalent linking group; $X_1$ and $X_2$, which may be the same or different, each represents a crosslinkable groups which contain an activated vinyl component; $Y_1$, $Y_2$, $Y_3$ and $Y_4$, which may be the same or different, each represents a hydrogen atom, an alkyl group, an alkenyl group, an aryl group, an aralkyl group or a crosslinkable group which contains an activated vinyl component; $Z_1$ and $Z_2$, which may be the same or different, each is a counter ion for balancing the electrical charge; and r is 0 or 1, provided that when r is 0, $L_4$ and $L_6$ together form a condensed ring.

2. A silver halide photographic material as in claim 1, wherein the repeating unit represented by formula (I) or (II) is contained in a fraction of from 2 to 60 mol% of the high molecular weight compound.

3. A silver halide photographic material as in claim 1, wherein the high molecular weight compound has an average molecular weight, as based on polyethylene oxide, of from 500 to 2,000,000.

4. A silver halide photographic material as in claim 1, wherein the high molecular weight compound also contains a repeating unit represented by the following formula (VI) or (VII):

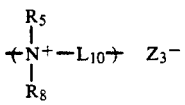

(VI)

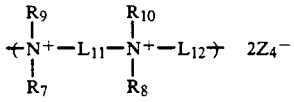

(VII)

wherein $R_5$ and $R_6$ each represents an alkyl group, an aryl group or a group in which such groups are combined, $L_{10}$ has the same meaning as $L_3$, $Z_3$ has the same meaning as $Z_1$, $L_{11}$ and $L_{12}$, which may be the same or different, each has the same meaning as $L_3$, $R_7$, $R_8$, $R_9$ and $R_{10}$ have the same meaning as $R_5$, $R_7$ and $R_8$, $R_9$ and $R_{10}$, $R_7$ and $R_9$, and $R_8$ and $R_{10}$ may be joined to form a condensed ring, and $Z_4$ has the same meaning as $Z_1$.

5. A silver halide photographic material as in claim 4, wherein the repeating unit represented by formula (V) is contained in a fraction of from 0 to 98% of the high molecular weight compound.

6. A silver halide photographic material as in claim 1, wherein the high molecular weight compound is incorporated into a subbing layer.

7. A silver halide photographic material as in claim 1, wherein the coated high molecular weight compound is caused to undergo a cross-linking reaction through irradiation or heating.

8. A silver halide photogrphic material as in claim 1, wherein the high molecular weight compound is contained in an amount of from 0.0001 to 2.0 g/m$^2$ of the photographic material.

9. A silver halide photographic material as in claim 1, wherein the high molecular weight compound is used as a mixture of two or more different kinds of high molecular weight compounds.

* * * * *